United States Patent [19]

Davis

[11] 4,259,811

[45] Apr. 7, 1981

[54] RELEASABLE RETAINING MEANS FOR A CLOSURE ELEMENT

[75] Inventor: Ronald P. Davis, Wellington, New Zealand

[73] Assignee: Interlock Industries Limited, Wellington, New Zealand

[21] Appl. No.: 81,851

[22] Filed: Oct. 4, 1979

[30] Foreign Application Priority Data

Oct. 18, 1978 [NZ] New Zealand ..... 188689

[51] Int. Cl.[3] ..... E05F 9/00

[52] U.S. Cl. ..... 49/356; 292/268

[58] Field of Search ..... 49/356, 394; 292/268, 292/269, 270

[56] References Cited

U.S. PATENT DOCUMENTS

| | | | |
|---|---|---|---|
| 2,175,861 | 10/1939 | Wall | 292/268 X |
| 2,760,805 | 8/1956 | Stevens et al. | 49/356 |
| 2,811,349 | 10/1957 | Bondurant et al. | 49/324 |
| 2,863,182 | 12/1958 | Gabor | 292/269 X |
| 3,458,226 | 7/1969 | Carlston | 292/268 |
| 4,119,336 | 10/1978 | Sparrevohn | 292/268 |

FOREIGN PATENT DOCUMENTS

| | | |
|---|---|---|
| 1428960 | 3/1976 | United Kingdom . |
| 1435698 | 5/1976 | United Kingdom . |
| 1500194 | 2/1978 | United Kingdom . |

*Primary Examiner*—Kenneth Downey
*Attorney, Agent, or Firm*—Young & Thompson

[57] ABSTRACT

A releasable retaining means for mounting on the inside of an outward opening closure element movable to open and close an opening. First and second mounting means (13 and 14) are respectively mountable on the closure element (11) and opening surround (12) with a stay (15) slidably and pivotably coupled to the second mounting means (14). Stay (15) is pivotably couplable by engagement means (22) to the first mounting means (13) and releasable therefrom by sliding stay (15) relative to mounting means (14) but only when the closure element is closed. Recoupling means (16, 24) automatically cause the engagement means (22) to couple to said first mounting means (13) when the closure (11) is moved into the closed position.

The retaining means thus prevents closure element (11) from opening more than a predetermined amount unless the stay (15) is released from the first mounting means (13) prior to opening the closure element (11). If stay (15) is released it becomes automatically recoupled on closing the closure element.

12 Claims, 9 Drawing Figures

RELEASABLE RETAINING MEANS FOR A CLOSURE ELEMENT

The present invention relates to a releasable retaining means for a closure element movable to open and close an opening, for example a window, shutter, door or like element hinged to a frame or other surround.

It is a common practice to equip an opening window with a retaining means which allows the window to be opened a certain amount for ventilation purposes but not far enough to provide a means for entry or egress. Generally, the window is permanently retained by such retaining means so that the retaining means cannot be disconnected to allow the window to be opened to a greater extent. There are occasions, however, when it may be desired to open the window fully, in which case there is a requirement for the retaining means to be able to be disconnected. It is important that such disconnection should not be able to be made from the exterior of the building or room to which the window is fitted, as this might provide an intruder with a convenient means of overcoming the controlled extent to which the window can normally open and thus negate the security value of the retaining means.

It is therefore the principal object of the present invention to provide a releasable retaining means which enables retention of a closure element and which permits release of the closure element only when the element is in a closed position.

Other objects and advantages of the invention will be apparent from the following description.

According to a first aspect of the present invention there is provided a releasable retaining means for a closure element movable to open and close an opening the retaining means comprising in combination a first mounting means mountable on such element, a second mounting means mountable on a surround of such opening, and a stay which is slidably and pivotably coupled to one of the mounting means, said stay having engagement means by which the stay is pivotably couplable to said other mounting means and releasable therefrom when and only when the two mounting means are in a relationship which, in use, corresponds to a closed position of the closure element, and recoupling means which automatically cause the engagement means to couple to said other mounting means when the two mounting means are moved relative to each other into said relationship.

Preferably, the stay, when coupled to said other mounting means, is releasable therefrom by slidable movement relative to said other mounting means into a release position, the stay and said other mounting means then being moved apart to effect release. The said other mounting means preferably comprises stop means to prevent such slidable movement of the stay except when the two mounting means are in the said relationship. The stop means expediently comprises a stop face engageable with the stay, for example an end portion of the stay.

Said recoupling means preferably comprises cam means on said other mounting means and cam follower means on the stay, the cam means being adapted to engage the cam follower means and displace the stay into a position in which it couples to said other mounting means.

In a preferred embodiment, the stay is provided at least at one end with a hook whereby the stay may be coupled to and released from said other mounting means, the latter being provided with a pin or similar element engageable in the hook to effect the coupling.

In the case where the stay includes a hook and is coupled to said other mounting means by engagement of the hook with the pin of that mounting means, the cam means may be provided by a surface of the pin and the cam follower means by a shaped end portion of the hook.

The stay and said one mounting means are preferably provided with interengaging guide means to guide slidable movement of the stay relative to said one mounting means. The guide means of the stay is preferably provided with at least one detent to define a locked position of the stay relative to said one mounting means.

Conveniently, the guide means of the stay comprises a slot extending longitudinally of the stay, the or each detent consisting of for example a recess in a wall of the slot, and the guide means of said one mounting means comprises a bearing element, for example a pin, engaged in the slot.

The invention also encompasses, in accordance with a second aspect thereof, a retaining means assembly comprising the two mounting means and stay according to the first aspect of the invention with the stay pivotably coupled to said other mounting means.

An embodiment of the present invention will now be more particularly described by way of example with reference to the accompanying drawings, in which.

Figure 1:
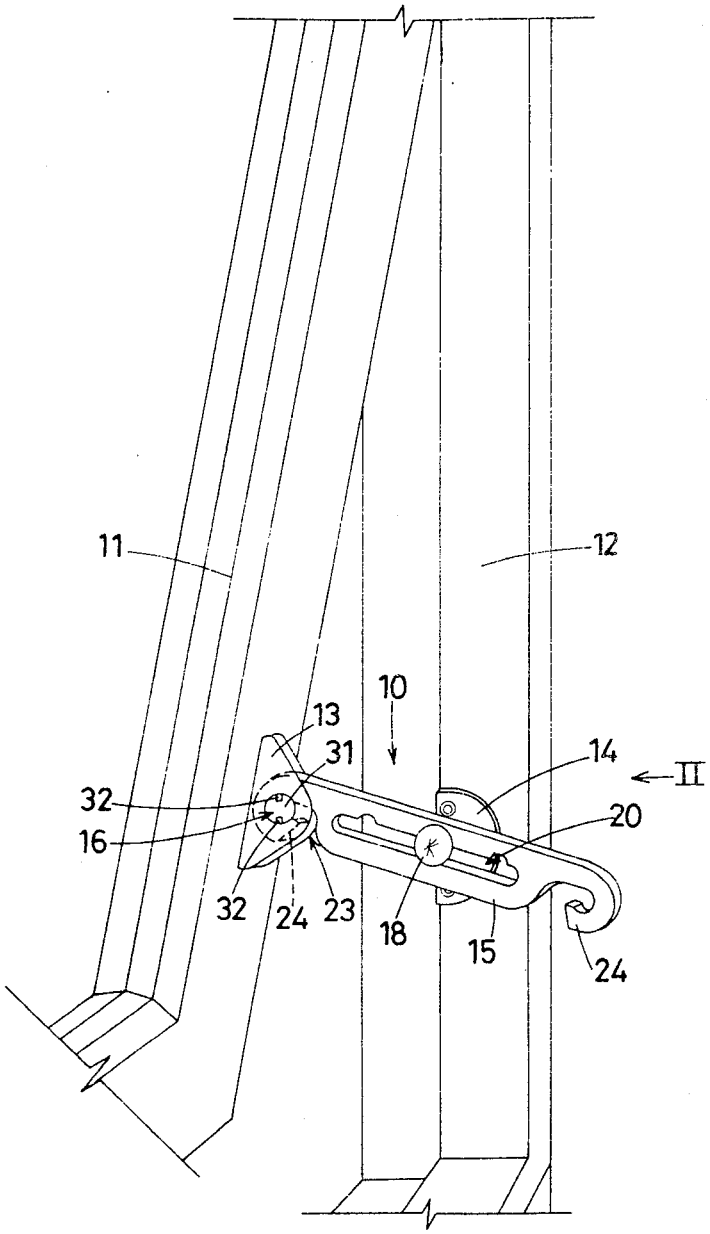
FIG. 1 is a perspective view of the retaining means according to the invention shown retaining a partly open window sash to a window frame.
Figure 2:
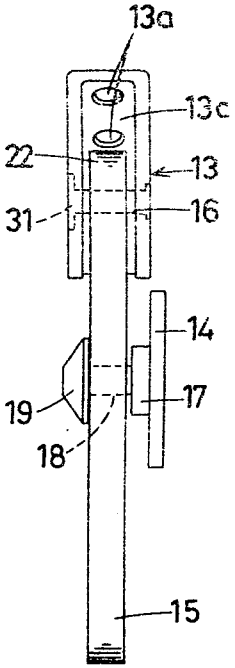
FIG. 2 is an end view of the retaining means when viewed in the direction of arrow II of FIG. 1.

In FIG. 1 there is shown a releasable retaining means 10 which in this particular instance serves to retain a window sash 11 to a frame 12. The retaining means 10 essentially consists of a first mounting bracket 13 mounted on sash 11, a second mounting bracket 14 mounted on frame 12, and a stay 15 pivotally and releasably coupled to bracket 13 and pivotably and slidably coupled to bracket 14.

First mounting bracket 13 is generally U-shaped and is made of metal, for example steel or aluminium. A metal pin 16 extends between and is anchored in the two arms of the bracket, the pin being disposed at a predetermined spacing from the inwardly facing surface **13*b* on the base portion 13*c*. Base portion 13*c* is provided with two or more holes 13*a* whereby it may be mounted by means of screws or other such fastening elements to sash 11**.

Instead of being U-shaped, bracket 13 may be L-shaped, the principal differences then being that pin 16 must find support in only one arm of the bracket and should be provided at its free end with an enlargement to prevent removal of the stay from the pin in the axial direction of the latter.

Second mounting bracket 14 is either L-shaped or flat (as shown) and is also made of a metal such as steel or aluminium. Bracket 14 incorporates a boss 17 with an axial bore, a pin 18 being received and anchored in this bore. Pin 18 has an enlarged head 19 disposed at a spacing from the free end of boss 17. Bracket 14 is provided with holes so that it can be mounted to a surface of frame 12.

Figure 8:
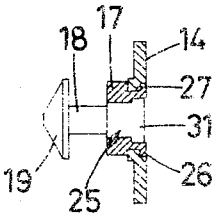
FIG. 8 is an assembled view of the bearing element of FIG. 7.
Figure 7:
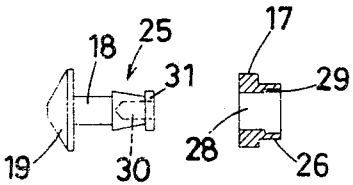
FIG. 7 is an exploded view of the bearing element of one of the mounting means.

The preferred form of pin 18 and its attachment to bracket 14 is illustrated in FIG. 7. Pin 18 has head 19 at one end and a profiled portion 25 at the other end. Boss 17 has an annular skirt 26 which fits into an aperture in bracket 14 and is deformed to engage with a land 27 formed in bracket 14 (see FIG. 8). The axial bore 28 in boss 17 and skirt 26 has an internal shoulder 29.

To assemble, the profiled end 25 is inserted into bore 28 until the inner end of end 25 is flush with the face of boss 17. A punch is then inserted into the blind bore 30 in end 25 to flow the flanged extremity 31 of end 25 onto the shoulder 29 and thus lock pin 18 into boss 17.

This construction of pin 18 and its assembly to boss 17 is not only economical for manufacture but provides a mounting of pin 18 which is not able to be readily disassembled by any unauthorised person.

Stay 15 is preferably made of metal, and is formed with a longitudinally extending slot 20 with closed ends. The portion of pin 18 between head 19 and boss 17 is engaged in this slot so as to slidably and pivotally couple stay 15 to bracket 14.

As can be seen in FIG. 1, the upper edge of the slot 20 has three spaced apart semi-circular recesses 21 which receive pin 18 in three correspondingly spaced angular settings of sash 11 relative to frame 12. Since during slidable movement of stay 15 relative to bracket 14 the upper edge of slot 20 bears on pin 18, stay 15 will drop under its own weight to notch pin 18 into these recesses.

Coupling of stay 15 to bracket 13 is effected by means of a hook 22 which is located at one end of the stay, the hook being an integral part of the stay. As illustrated hook 22 is provided at each end of stay 15 so that the retaining means can be mounted to either side of frame 12. Hook 22 encloses a slot-shaped opening **22*a* that extends in alignment with slot 20, and pin 16 is pivotably—and, in certain circumstances, slidably—engaged in this opening. The free end of hook 22 is spaced from an adjacent surface of stay 15 to define a passage 23 of a width not less than the diameter of pin 16, this passage serving as a means of escape of pin 16 from the hook and thus release of bracket 13** from the stay.

The free end of hook 22 is formed with an inclined cam surface 24 which, as will be explained in more detail in connection with FIG. 6, co-operates with pin 16 to effect automatic recoupling of bracket 13 to the stay.

The retaining means 10 may be used in conjunction with inter alia an awning (top-hung) or a casement (side-hung) window sash (in FIG. 1 an awning window is represented) and when a casement window is concerned account should be taken of the fact that the retaining means must accommodate angular movement of brackets 13 and 14 relative to each other about a vertical axis. In the illustrated embodiment, this is achieved by so spacing the arms of bracket 13 apart and dimensioning pin 16 and opening **22*a* that the bracket 13 can pivot on a vertical axis relative to stay 15, the latter being constrained to remain in a vertical plane by bracket 14. The degree of such pivotal movement of bracket 13 to be accommodated depends on the length of slot 20 and thus the extent to which the sash can be opened. It will be appreciated that the particular embodiment shown in the drawings is intended for sashes which can be opened only relatively short amounts, for example 100 millimeters. If substantially greater amounts are contemplated, further compensation for angular movement of the two brackets relative to each other about one or more vertical axes will be required, for example by provision of a universal joint at either or each bracket 13 and 14**.

It may also be found expedient, when the retaining means is intended for use with a casement window, to provide a reduction in the radial thickness of the hook 22 intermediate its root and its free end so that any pivotal movement of the bracket 13 about a vertical axis does not normally bring the outer surface of the hook into contact with surface **13*b* of bracket 13**.

Figure 3:
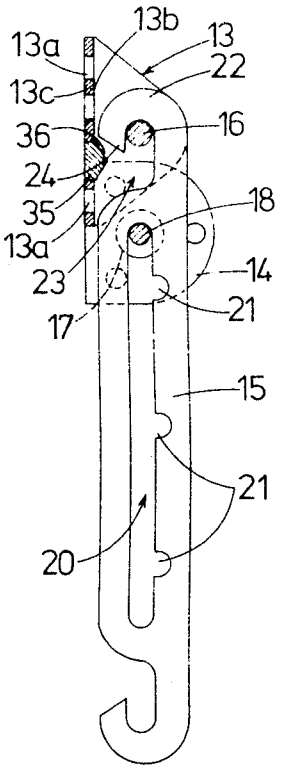

In use of the retaining means 10, as shown in FIG. 3 brackets 13 and 14 are mounted to sash 11 and frame 12, respectively, with bracket 13 immediately above bracket 14 and stay 15 substantially vertically disposed when the sash is in the closed position.

When sash 11 is opened (as shown in FIG. 1), stay 15 slides over pin 18 whilst at the same time pivoting relative to brackets 13 and 14 about the axes of pins 16 and 18 respectively to accommodate the changing angular relationship of sash 11 and frame 12. The retaining means thus ensures that sash 11 can be opened only a controlled amount, this amount being predetermined to be insufficient to allow entry or egress through the window opening.

Engagement of the pin 18 in one of recesses 21 allows sash 11 to be latched in one of three positions but is easily unlatched by simply lifting stay 15 to disengage pin 18 from recess 21.

Figure 5:
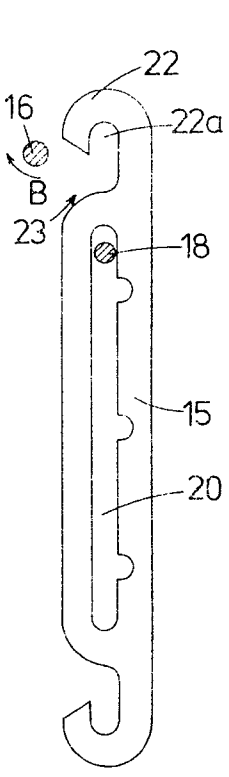
FIGS. 3, 4 and 5 are schematic elevations of the retaining means showing three successive stages in release of the sash from the frame.
Figure 4:
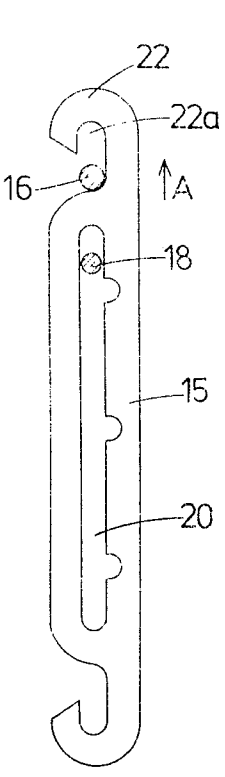

If it is desired to disconnect the retaining means so that the sash can be opened completely, then the sash must first be moved to its fully closed position as shown in FIG. 3. In this position stay 15 is vertical and can be lifted as indicated by the arrow A in FIG. 4 until pin 16 is aligned with escape passage 23 as indicated by arrow B in FIG. 5. Once released stay 15 can be allowed to drop under gravity to sit on pin 18.

Release of the stay can be readily accomplished but only when the sash is closed, and only from the interior of the room having the window.

Referring to FIG. 1, it will be apparent that any attempt to move stay 15 and bracket 13 relative to each other to bring pin 16 into alignment with escape passage 23 will be prevented, other than when the sash is in the closed position, by contact of the outer peripheral surface of hook 22 with the surface or stop face **13*b*. The spacing of pin 16 from stop face 13*b* is so related to the radial thickness of hook 22 and the return length of the free end portion of the hook that contact between the outer peripheral surface of the hook and stop face 13*b*** will take place in all circumstances except when the sash is closed.

It follows, of course, that the stay may be pivoted away from pin 16 rather than vice versa to effect the release.

Figure 6:
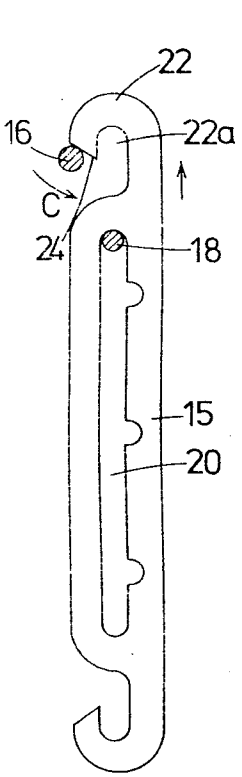
FIG. 6 is a schematic elevation of the retaining means illustrating automatic return of the sash to the state of being retained to the frame.

To effect automatic recoupling of pin 16 and thus sash 11 with stay 15, the sash is moved from an open position to its closed position to bring the pin 16 into contact with cam surface 24 of hook 22, as shown in FIG. 6. Continuing movement of the sash in the direction of arrow C in FIG. 6 will cause cam surface 24 and thus stay 15 to ride up on pin 16 so that pin 16 passes back along escape passage 23 and into the base of opening 22*a* in the hook. The instant pin 16 reaches this position it will have passed beyond the lowermost end of cam surface 24 so that the end of the hook no longer bears on pin 16 stay 15 can drop under its own weight into the position shown in FIG. 3. If the sash is now re-opened, the retaining means will operate as shown in FIG. 1.

A feature of brackets 13 and 14 is that access to the screws securing the brackets to the sash and frame, is relatively restricted when the sash is open which hinders unauthorised removal of either bracket when the sash is open.

Figure 9:
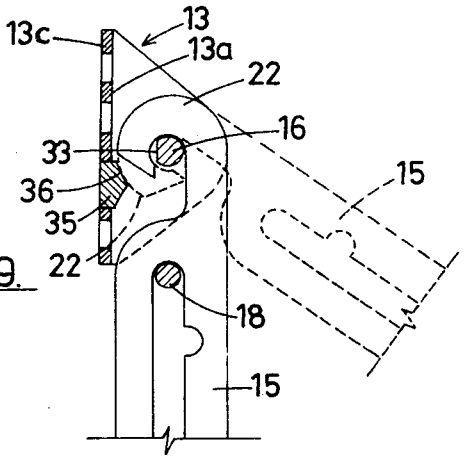
FIG. 9 is a part side view of the retaining means according to a modified form.

To prevent accidental uncoupling of stay 15 from bracket 13, by for example a child playing with the retaining means, a locking means is provided. This is achieved by pin 16 being rotatably mounted in bracket 13. An enlarged head 31 at one end of pin 16 has a pair of diametrically opposed notches 32. The body of pin 16 has at least one flat 33 formed thereon (see FIG. 9).

Referring to FIG. 10, it will be seen that the distance between the free end of hook 22 is spaced at a distance from the adjacent surface of stay 15 which is less than the diameter of pin 16. Accordingly, pin 16 can only pass through passage 23 when sash 11 is closed and pin 16 has been rotated by a key, fitted into notches 32, until flat 33 is vertically disposed.

To prevent the stay 15 from rattling in bracket 13 when the retaining means is employed to retain the sash in an open position (i.e. pin 18 is located in one of recesses 21) a resilient buffer 35 is located in base 13*c* of bracket 13. This buffer 35 has a conical surface 36 with which the surface of hook 22 engages when stay 15 is in a position such as shown in dotted in FIG. 9. Hook 22 is therefore engaged between buffer 35 and pin 16 such that it is not a loose fit and thus cannot freely move or rattle. The engagement is such however that hook 22 can be rotated about pin 16 during normal opening or closing of the sash.

It will be readily apparent that the retaining means hereinbefore described may be modified without departing from the scope of the invention, for example the stay and the mounting bracket to which it is releasably coupled may co-operate in a different manner, such as through differently arranged stop surfaces or abutments, to prevent release of the stay while the window is open. It will also be appreciated that the bracket to which the stay is releasably coupled may be mounted on the frame rather than the window sash.

A releasable retaining means embodying this invention may be relatively economical to manufacture and is comparatively simple to operate.

What is claimed is:

1. A releasable retaining means for mounting on the inside of an outward opening closure element movable to open and close an opening the retaining means comprising in combination a first mounting means mountable on such element, a second mounting means mountable on a surround of such opening, and a stay which is slidably and pivotably coupled to one of the mounting means, the stay and said one mounting means being provided with interengaging guide means to guide slidable movement of the stay relative to said one mounting means said stay having engagement means by which the stay is pivotably couplable to said other mounting means and releasable therefrom when and only when the two mounting means are in a relationship which, in use, corresponds to a closed position of the closure element, said release of the stay from said other mounting means being achieved by the stay being slid relative to said other mounting means to a position where the engagement means and said other mounting means can be moved apart, and recoupling means which automatically cause the engagement means to couple to said other mounting means when the two mounting means are moved relative to each other into said relationship.

2. A releasable retaining means as claimed in claim 1, wherein said other mounting means preferably comprises stop means to prevent slidable movement of the stay relative to said one mounting means except when the two mounting means are in said relationship.

3. A releasable retaining means as claimed in claim 1 or 2, wherein said recoupling means comprises cam means and said other mounting means and cam follower means on the stay, the cam means being adapted to engage the cam follower means and displace the stay into a position where said engagement means couples the stay to said other mounting means.

4. A releasable retaining means as claimed in claim 3, wherein the engagement means is a hook provided at one end of the stay and said other mounting means being provided with a pin or similar element engageable in the hook to effect the coupling.

5. A releasable retaining means as claimed in claim 4 wherein the cam means is formed by a surface of the pin or similar element and the cam follower means by a shaped end portion of the hook.

6. A releasable retaining means as claimed in any one of claims 1 or 5, wherein the guide means of the stay is a slot extending longitudinally of the stay and the guide means of said one mounting means comprises a bearing element engaged in the slot.

7. A releasable retaining means as claimed in claim 6, wherein the slot is provided with at least one recess in the wall thereof into which said bearing element can locate to define a locked position of the stay relative to said one mounting means, said stay being moved gravitationally when slid relative to said one mounting means to effect location of the bearing element with said recess.

8. A releasable retaining means as claimed in claim 4, wherein the said other mounting means is the first mounting means and comprises a generally U shaped bracket with said pin extending between the arms of the bracket and being mounted to be rotatable, said pin having an area of reduced cross-sectional thickness such that the pin can only be disengaged from said hook when said two mounting means are in said relationship and said area of reduced cross-sectional thickness is positioned such as to be able to pass through an escape passage from said hook.

9. A releasable retaining means as claimed in claim 6, wherein the said one mounting means is the second mounting means and comprises a plate from which extends the bearing element which is in the form of a pin, said pin having an enlarged head portion at the free end thereof.

10. A releasable retaining means as claimed in claim 4, wherein the said other mounting means includes a resilient buffer which engages with a surface of said hook when the two mounting means are moved away from said relationship, said buffer causing said hook to be movably gripped between a surface of said buffer and the pin of said other mounting means.

11. A releasable retaining means as claimed in claim 4, wherein a said hook is provided at each end of the stay.

12. A releasable retaining means as claimed in claim 10, wherein a boss is provided with said plate, said bearing pin having a flanged end which fits into said boss and deformed to locate on a shoulder within said boss to lock said pin to said boss.

* * * * *